US008925875B2

(12) United States Patent
Horvath

(10) Patent No.: US 8,925,875 B2
(45) Date of Patent: Jan. 6, 2015

(54) SUPPORT STAND FOR DISPOSAL BAGS

(71) Applicant: Matthew Horvath, Edmonton (CA)

(72) Inventor: Matthew Horvath, Edmonton (CA)

( * ) Notice: Subject to any disclaimer, the term of this patent is extended or adjusted under 35 U.S.C. 154(b) by 0 days.

(21) Appl. No.: 13/861,103

(22) Filed: Apr. 11, 2013

(65) Prior Publication Data

US 2013/0270401 A1 Oct. 17, 2013

(30) Foreign Application Priority Data

Apr. 11, 2012 (CA) ..... 2773621

(51) Int. Cl.
*B65B 67/04* (2006.01)
*B65F 1/14* (2006.01)

(52) U.S. Cl.
CPC ..... *B65F 1/1415* (2013.01)
USPC ..... 248/99; 248/97; 248/150; 248/440

(58) Field of Classification Search
CPC B65B 67/12; B65B 67/1238; B65B 67/1205; B65F 1/1415
USPC ..... 248/95, 97, 99, 100, 101, 150, 175, 248/440, 440.1, 165
See application file for complete search history.

(56) References Cited

U.S. PATENT DOCUMENTS

| | | | | |
|---|---|---|---|---|
| 292,648 | A * | 1/1884 | Hayman | 248/97 |
| 1,233,832 | A * | 7/1917 | Borbour | 220/9.3 |
| 2,470,977 | A * | 5/1949 | Chidsey, Jr. | 248/97 |
| 2,650,011 | A * | 8/1953 | Anderson | 141/51 |
| 4,705,247 | A * | 11/1987 | Delmerico | 248/98 |
| 4,989,749 | A * | 2/1991 | Choi | 280/47.34 |
| 5,427,340 | A * | 6/1995 | Stromsmoe et al. | 248/97 |
| 6,267,334 | B1 * | 7/2001 | Siu | 248/97 |
| 6,286,792 | B1 * | 9/2001 | Best | 248/97 |
| 6,402,098 | B2 * | 6/2002 | Rosky | 248/99 |
| 6,676,092 | B2 * | 1/2004 | Tsai | 248/97 |
| 2011/0168854 | A1 * | 7/2011 | Chen | 248/97 |

FOREIGN PATENT DOCUMENTS

| | | | |
|---|---|---|---|
| EP | 2514653 | A2 * | 10/2012 |
| GB | 2377923 | A * | 1/2003 |

* cited by examiner

*Primary Examiner* — Gwendolyn W Baxter
(74) *Attorney, Agent, or Firm* — Christensen O'Connor Johnson Kindness PLLC

(57) ABSTRACT

A support stand for disposal bags includes a base and at least four posts extending upwardly from the base. Each post terminates in an upper extremity. An extendable tip is positioned at the upper extremity of each post. Each extendable tip is movable between an extended position and a retracted position. Extendable tips are maintained in the extended position by a locking mechanism. Releasing the locking mechanism on one or more extendable tip causes the extendable tip to move to the retracted position thereby relieving tension on a disposal bag that is supported in the support stand to avoid binding between the disposal bag and the posts.

5 Claims, 5 Drawing Sheets

SUPPORT STAND FOR DISPOSAL BAGS

FIELD

This relates to the field of stands for holding disposal bags; in particular, stands for holding disposal bags which are now supplanting dumpster bins.

BACKGROUND

U.S. Pat. No. 5,725,348 (Drake) discloses a vehicle with a lifting apparatus and a large dumpster bin. Large bags are now being used to replace large dumpster bins. These large bags are supported on support stands. As a bag becomes filled, it tends to expand outwardly and binds within the stand. This creates difficulties when a vehicle with a lifting apparatus comes to lift the large bag from the support stand. What is needed is a support stand which addresses this problem of binding.

SUMMARY

There is provided a support stand for disposal bags that includes a base with at least four posts extending upwardly from the base. Each post terminates in an upper extremity. An extendable tip is positioned at the upper extremity of each post. Extendable tips are movable between an extended position and a retracted position and are maintained in the extended position or retracted position by a locking mechanism. Releasing the locking mechanism on one or more extendable tip causes the extendable tip to move to the retracted position thereby relieving tension on a disposal bag being supported within support stand to avoid binding between the disposal bag and the posts.

Beneficial results have been seen when the support stand is collapsible and the base has a first portion and a second portion. Each of the first portion and the second stand portion has a tubular body with a first end and a second end. Post receivers are positioned at each of the first end and the second end for receiving posts. A linkage is provided on the tubular body for coupling the first portion and the second portion together.

Further beneficial results have been seen when each tubular body defines a V shape with a narrow bridge member connecting diverging arms. The linkage is positioned along the narrow bridge member. Beneficial results have also been seen when the linkage between the first portion and the second portion is a pin connection.

Beneficial results have also been seen when braces extend between pairs of the posts and serve to limit relative movement of the posts under load. These braces provide additional stability to the support stand.

Further beneficial results have been shown when the locking mechanism is a locking pin that extends through the extendible tip into the post.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
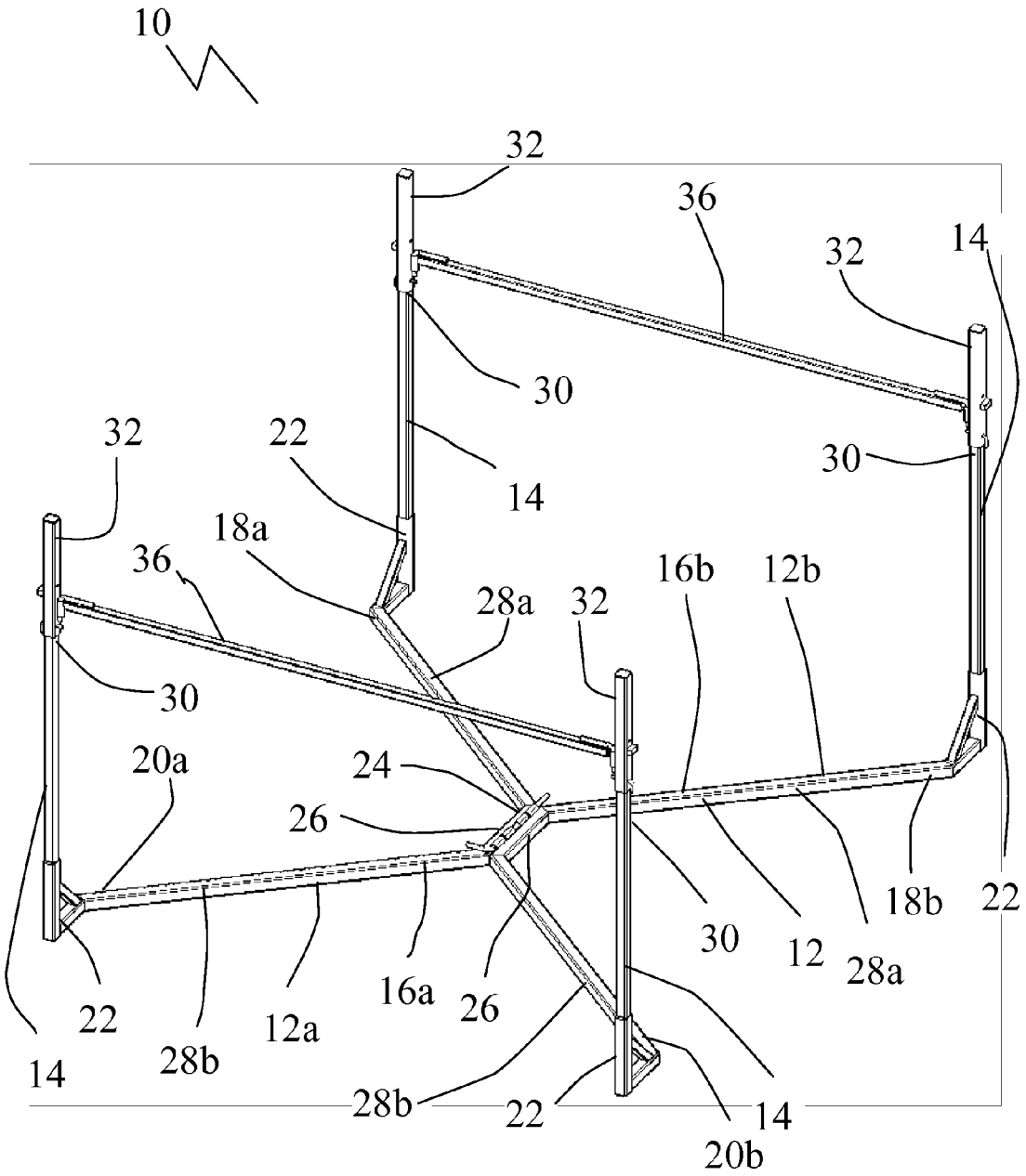
FIG. 1 is a perspective view of a support stand for disposal bags.

A support stand for disposal bags generally identified by reference numeral 10, will now be described with reference to FIGS. 1-5.

Figure 3:
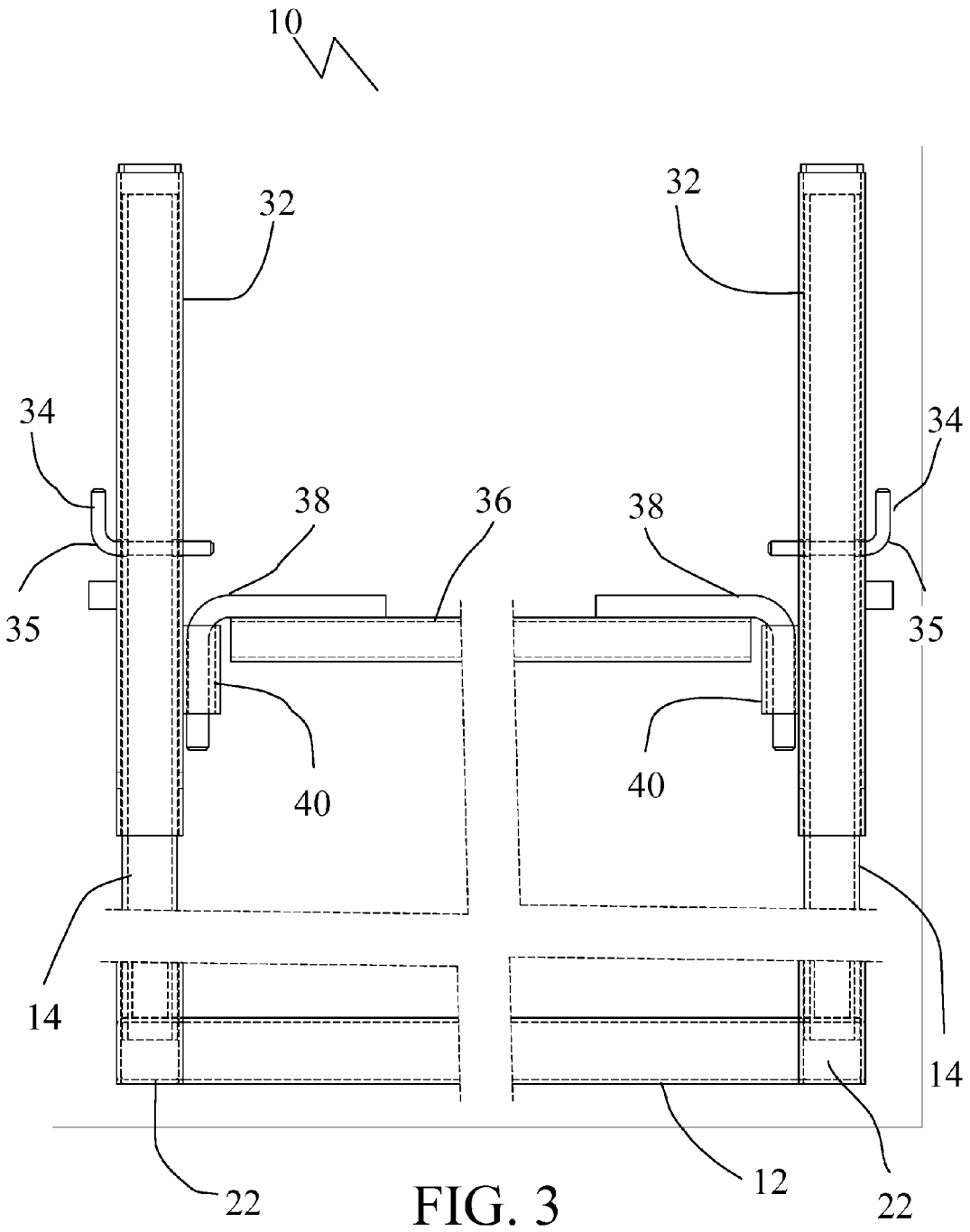
FIG. 3 is a side elevation view, partially in section, of the support stand in the retracted position.
Figure 4:
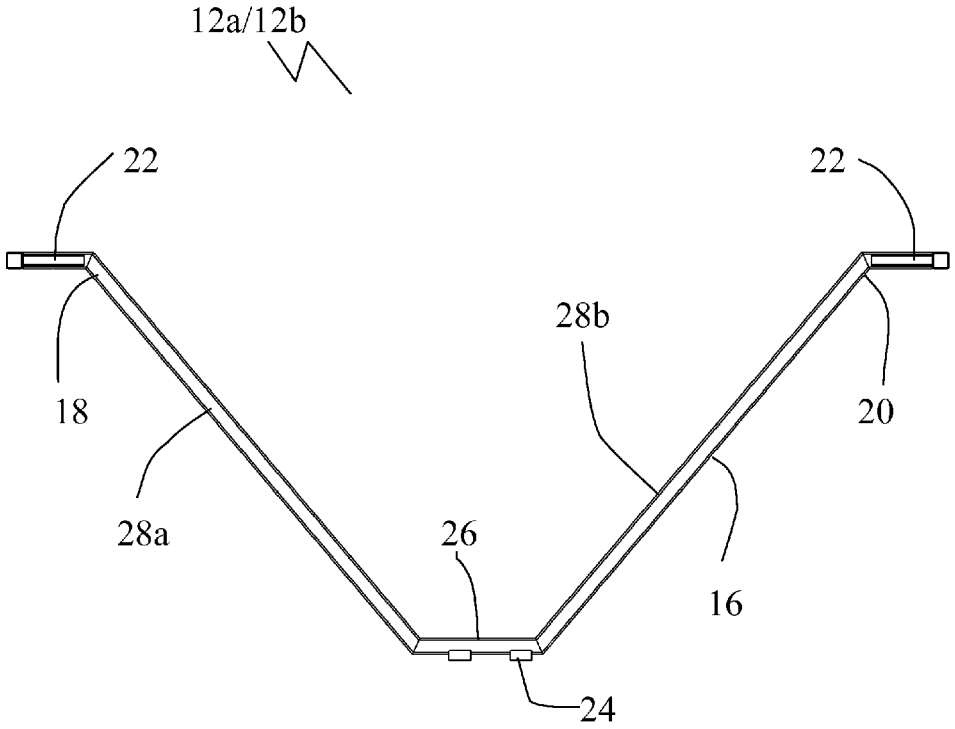
FIG. 4 is a top plan view of a portion of the base of the support stand shown in FIG. 1.

Structure and Relationship of Parts:

Referring to FIG. 1, a support stand for disposal bags 10 has a base 12 with at least four posts 14 extending upwardly from base 12. In the embodiment shown, base 12 is made up of a first portion 12*a* and a second portion 12*b* which allows support stand 10 to be collapsed for storage or transport. Each of first portion 12*a* and second portion 12*b* have a tubular body 16*a* and 16*b* with a first end 18*a* and 18*b* and a second end 20*a* and 20*b* with post receivers 22 positioned at each of first end 18*a* and 18*b* and second end 20*a* and 20*b*. A linkage 24 on tubular body 16*a* and 16*b* couples first portion 12*a* and second portion 12*b* together. In the embodiment shown, linkage 24 is a pin connection, however it will be understood that different types of linkages such as clamps may be used. Referring to FIG. 4, it is preferable that tubular body 16 be a "V" shape with a narrow bridge member 26 connecting diverging arms 28*a* and 28*b* and linkage 24 positioned along narrow bridge member 26 of tubular body 16. Referring to FIG. 1, each post 14 terminates in an upper extremity 30. An extendable tip 32 is positioned at upper extremity 30 of each post 14 and is movable between an extended position, shown in FIG. 2, and a retracted position, shown in FIG. 3.

Figure 2:
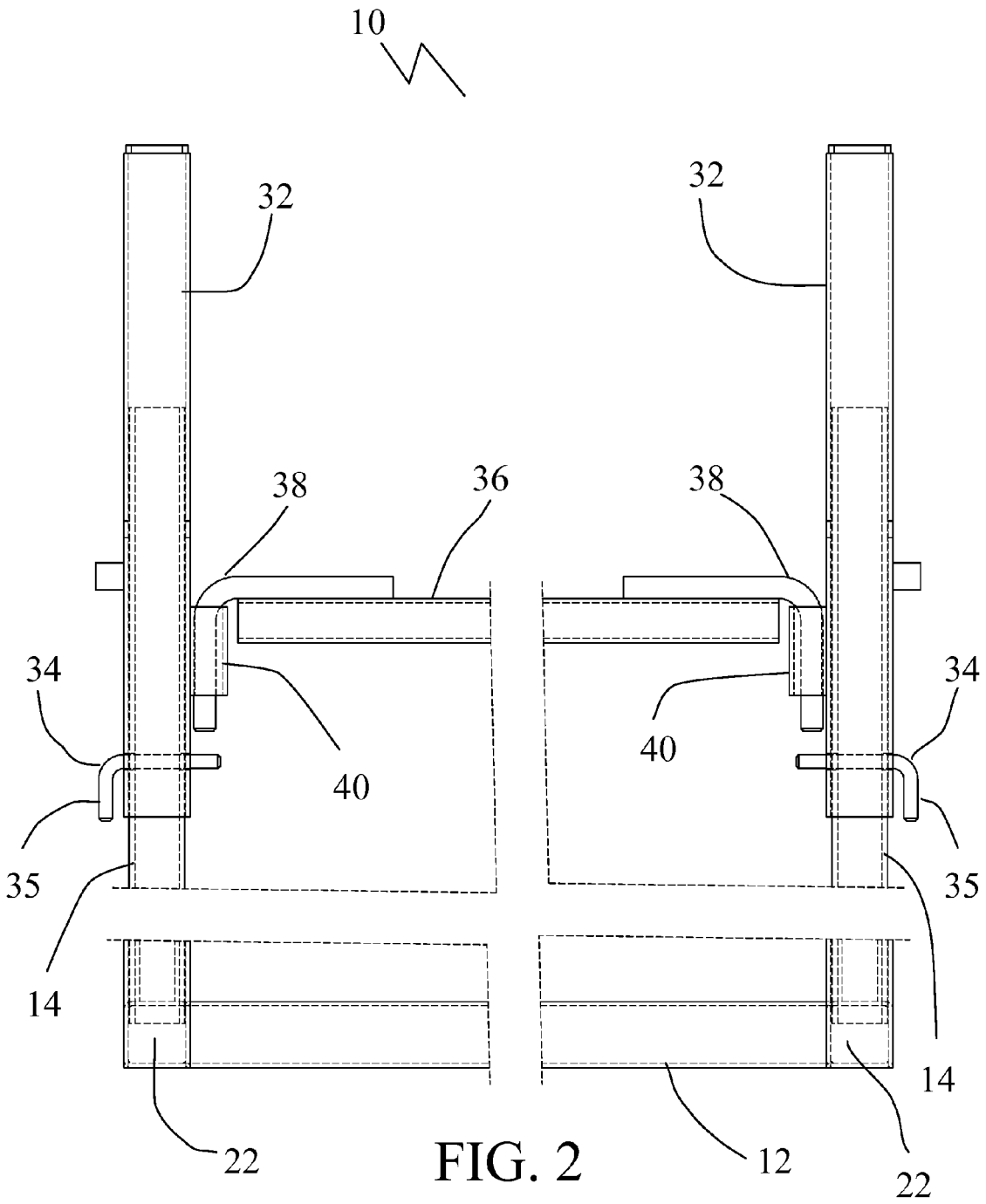
FIG. 2 is a side elevation view, partially in section, of the support stand in the extended position.

Referring to FIG. 2, extendable tips 32 are each maintained in the extended position by a locking mechanism 34 and may be extended or retracted independently of each other. In the embodiment shown, locking mechanism 34 is a locking pin 35 that extends through extendible tips 32 into posts 14. Referring to FIG. 3, releasing locking mechanism 34 on one or more extendable tips 32 causes extendable tip 32 to move to the retracted position thereby relieving tension on a disposal bag being supported (not shown), to avoid binding between the disposal bag and posts 14. To help stabilize support stand 10, braces 36 may extend between pairs of posts 14. In the embodiment shown, braces 36 are connected to extendable tips 32, however braces 36 may be positioned lower on posts 14. Braces 36 are shown as being removable, however braces 36 may be welded into position. Removable braces 36 has a first connection 38 which connects with a second connection 40 positioned on extendible tips 32 or posts 14.

Figure 5:
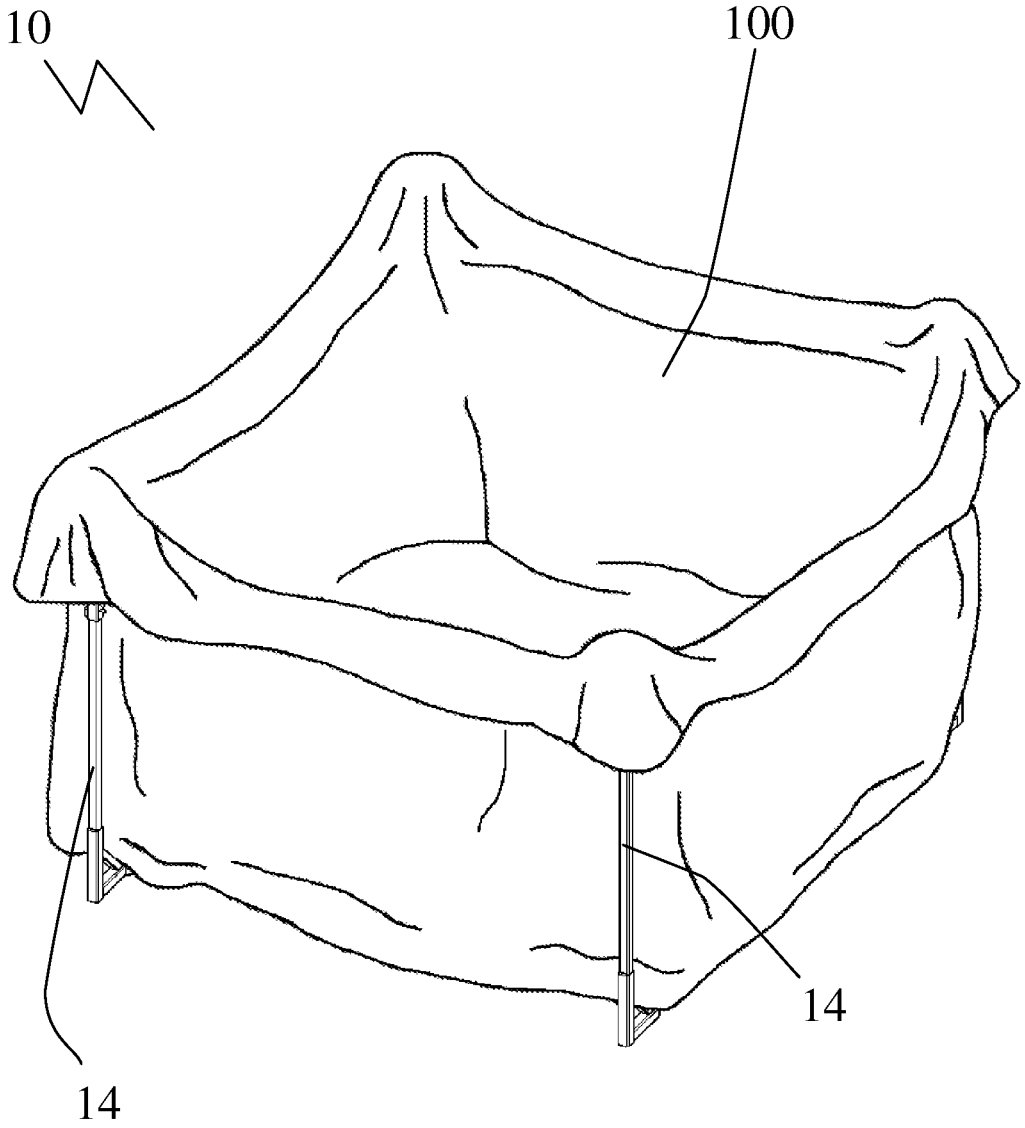
FIG. 5 is a perspective view of a support stand for disposal bags showing a disposal bag in use.

Operation:

Referring to FIG. 1, support stand 10 is placed in position. In the embodiment shown, first portion 12*a* and second portion 12*b* are connected by linkage 24. Posts 14 are held substantially vertically within post receivers 22 with extendible tips 32 positioned on upper extremities 30. Braces 36 are connected to extendable tips 32 to provide additional stabilization to support stand 10. Referring to FIG. 2, extendable tips 32 are moved to the extended position and held in position by locking pin 35. Referring to FIG. 5, a disposal bag 100 is held open on extendable tips 32 to facilitating filling of the disposal bag. As disposal bag fills, it expands outwards. Referring to FIG. 3, when disposal bag is to be removed from support stand 10, locking pins 35 are removed enabling extendable tips 32 to move to the retracted position. With extendable tips 32 in the retracted position, the disposal bag is less likely to bind against posts 14 as the disposal bag lifted from support stand 10 by a mechanical lift arm.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A collapsible support stand for disposal bags, comprising:

a base, comprising:

a first portion and a second portion, each of the first portion and the second portion comprising:

a tubular body having a first end and a second end;

post receivers positioned at each of the first end and the second end; and a linkage on the tubular body for coupling the first portion and the second portion together;

at least four posts extending upwardly from the base, each post terminating in an upper extremity;

an extendable tip positioned at the upper extremity of each post, said each extendable tip being movable between an extended position and a retracted position, said each extendable tip being maintained in the extended position by a locking mechanism, wherein releasing the locking mechanism on one or more extendable tip causes the one or more extendable tip to move to the retracted position thereby relieving tension on a disposal bag being supported to avoid binding between the disposal bag and the posts.

2. The collapsible support stand of claim 1, wherein each tubular body defines a V shape with a narrow bridge member connecting diverging arms, the linkage being positioned along the narrow bridge member.

3. The collapsible support stand of claim 1, further comprising braces that extend between pairs of the posts, the braces serving to limit relative movement of the posts under load.

4. The collapsible support stand of claim 1, wherein the linkage between the first portion and the second portion is a pin connection.

5. The collapsible support stand of claim 1, wherein the locking mechanism is a locking pin that extends through the extendible tip into the post.

* * * * *